US007703448B2

(12) United States Patent
Chia

(10) Patent No.: US 7,703,448 B2
(45) Date of Patent: Apr. 27, 2010

(54) MORTAR LAUNCHING TOY

(76) Inventor: Francis See Chong Chia, 17 Kadoorie Ave, Kowloon, Hong Kong (CN)

( * ) Notice: Subject to any disclaimer, the term of this patent is extended or adjusted under 35 U.S.C. 154(b) by 474 days.

(21) Appl. No.: 11/858,150

(22) Filed: Sep. 20, 2007

(65) Prior Publication Data

US 2009/0071456 A1 Mar. 19, 2009

Related U.S. Application Data

(60) Provisional application No. 60/972,761, filed on Sep. 15, 2007.

(51) Int. Cl.
*F41B 7/08* (2006.01)

(52) U.S. Cl. ..... 124/27; 124/29

(58) Field of Classification Search ..... 124/16, 124/26, 27, 28, 29, 37
See application file for complete search history.

(56) References Cited

U.S. PATENT DOCUMENTS 3,154,062 A * 10/1964 Ryan ..... 124/16
3,191,342 A * 6/1965 Chalmers ..... 446/231
3,253,586 A * 5/1966 Strauss ..... 124/66
3,254,640 A * 6/1966 Sprouse ..... 124/16
3,430,620 A * 3/1969 Davis ..... 124/27
3,465,744 A * 9/1969 Nielsen ..... 124/27
5,803,060 A * 9/1998 Skivran ..... 124/16

* cited by examiner

*Primary Examiner*—John Ricci
(74) *Attorney, Agent, or Firm*—Frank Marino

(57) ABSTRACT

A mortar launching toy has an angularly adjustable firing barrel and a soft rocket-shaped toy mortar for being launched from the barrel in various modes of play. The toy includes a spring-activated launching pole to which the mortar is preloaded, the mortar/pole subassembly is loaded into the barrel to prepare for launching. A locking feature retains the subassembly in the barrel prior to launching. A trigger mechanism cooperates with a symmetrical dual-finger release mechanism to release the mortar during launching. The locking feature retains the launching pole in the barrel during launching.

20 Claims, 4 Drawing Sheets

MORTAR LAUNCHING TOY

RELATED APPLICATION

This application claims the benefit of pending U.S. Provisional application Ser. No. 60/972,761, filed Sep. 15, 2007, the entire teachings of which are incorporated herein by reference.

FIELD OF THE INVENTION

The present invention is related to projectile shooting toys.

SUMMARY OF THE INVENTION

The present invention comprises a soft rocket-shaped mortar and a launching toy for use therewith. The release mechanism provides consistent and true launching with improved distance and speed. The loading mechanism provides ease and reliability and eliminates inadvertent launching. Further features and aspects of the invention are disclosed with more specificity in the Detailed Description and Drawings of an exemplary embodiment provided herein.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

Figure 1:
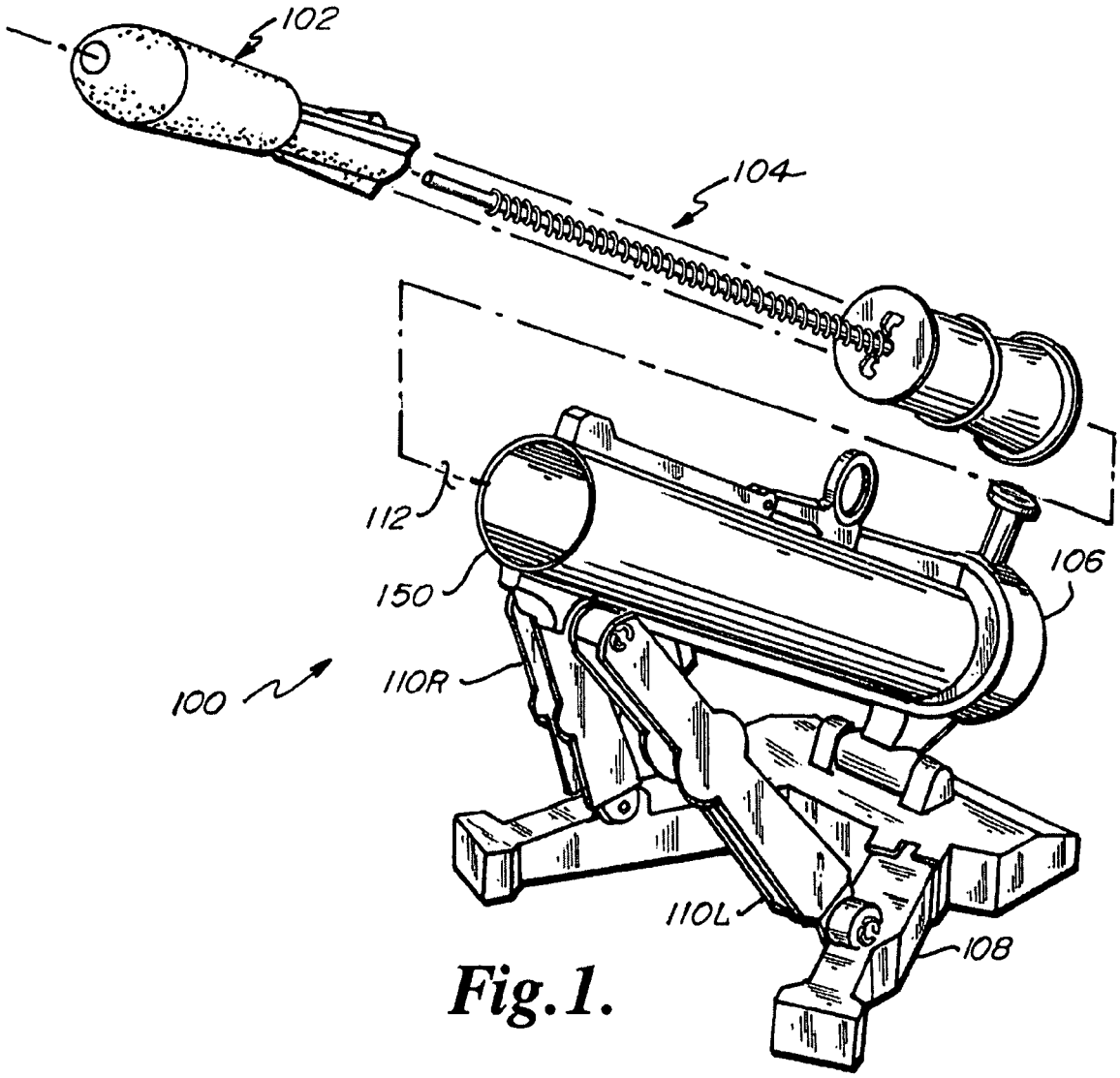
FIG. 1 is an exploded of a mortar launching toy in accordance with an exemplary embodiment of the invention.

Reference is now made to FIGS. 1 through 7 where there is shown a mortar launching toy according to an exemplary embodiment of the invention. Toy 100 comprises a mortar 102, a launching pole 104, a barrel 106, and a stand that includes a base 108 and two supports 110L and 110R. The cylindrical barrel defines a longitudinal axis 112.

Figure 2:
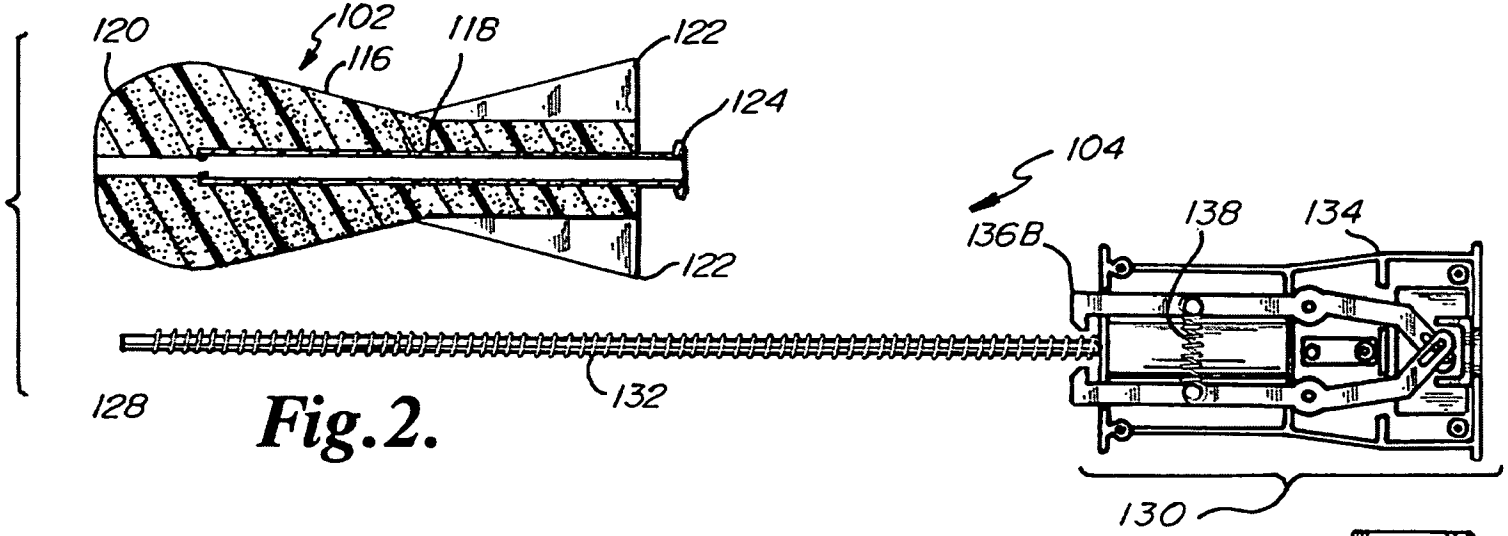
FIG. 2 is a full cross sectional view of the mortar and launching pole of the toy of FIG. 1.

Referring to FIG. 2, mortar 102 is a rocket-shaped missile, having a body 116 preferably made of a soft foam material, such as Polyethylene foam, polypropylene foam, or EVA foam, surrounding a rigid hollow central tube 118. The tail end of the hollow central tube 118 includes a peripheral flange 124.

The body includes a nose portion 120 and flight-stabilizing fins 122. The body may be integrally and homogenously formed, or may be an assembly. If the body is an assembly, the fins and nose may be constructed of various materials and contrasting colors. The colors may be bright, such as red and yellow, for maximum visibility. If the body is an assembly, the fins 122 may be of a more rigid material for added flight stability, while the nose 120 of the mortar may be made of a softer material for added safety.

Referring still to FIG. 2, the launching pole 104 is an assembly of a guiding rod 128 and a release mechanism 130. The guiding rod is surrounded by a longitudinal extension spring 132. The release mechanism includes a cylindrical housing 134 surrounding a pair of holding fingers 136A and 136B which are cooperatively connected in "scissors jack" fashion. The fingers have a "holding position" shown in FIG. 6, and a "releasing position", shown in FIG. 7. In the holding position, the fingers 136A and 136B are drawn symmetrically inwardly towards the cylindrical housing's longitudinal axis 142. In the releasing position, the fingers are forced symmetrically outwardly away from the cylindrical housing's longitudinal axis 142. The fingers a biased towards the holding position by a holding spring 138.

Figure 6:
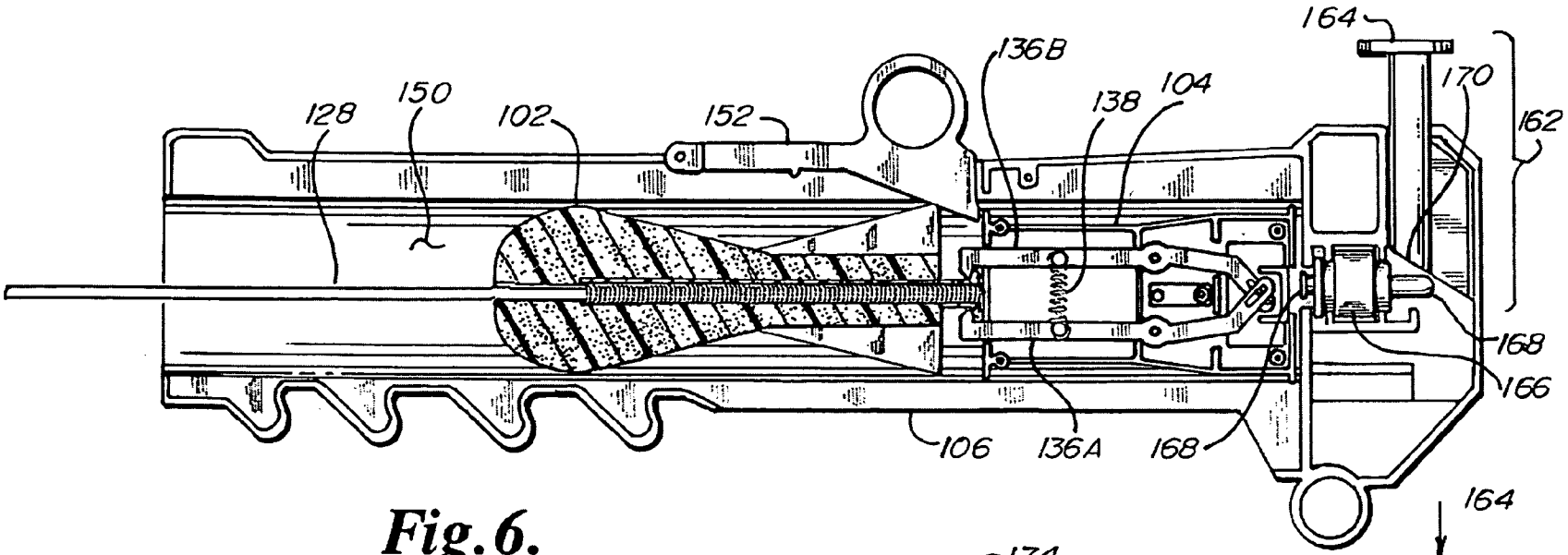
FIG. 6 is a cross sectional view through the loaded mortar/pole/barrel assembly of FIG. 5 ready for launching.
Figure 7:
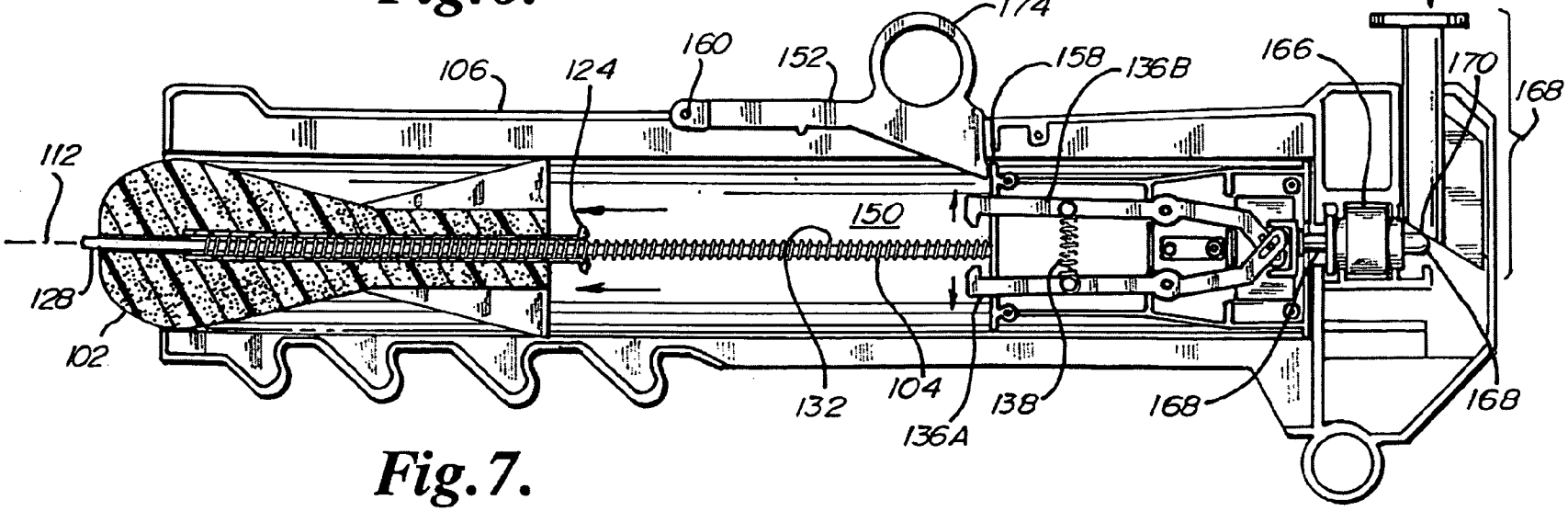
FIG. 7 is a cross sectional view through the assembly of FIG. 6 showing the launching of the mortar.

As seen by comparison of FIGS. 6 and 7, during releasing motion from the holding position to the releasing position, fingers 136A and 136B pivot equally and oppositely approximate their longitudinal midpoints about pins 140A and 140B of housing 134, and the tail ends of the fingers are hingedly fixed along the housing's longitudinal axis 142. This causes the releasing motion to be perfectly symmetrical, which is found to be advantageous in providing straight and true trajectory of the mortar, as will be further described.

Figure 4:
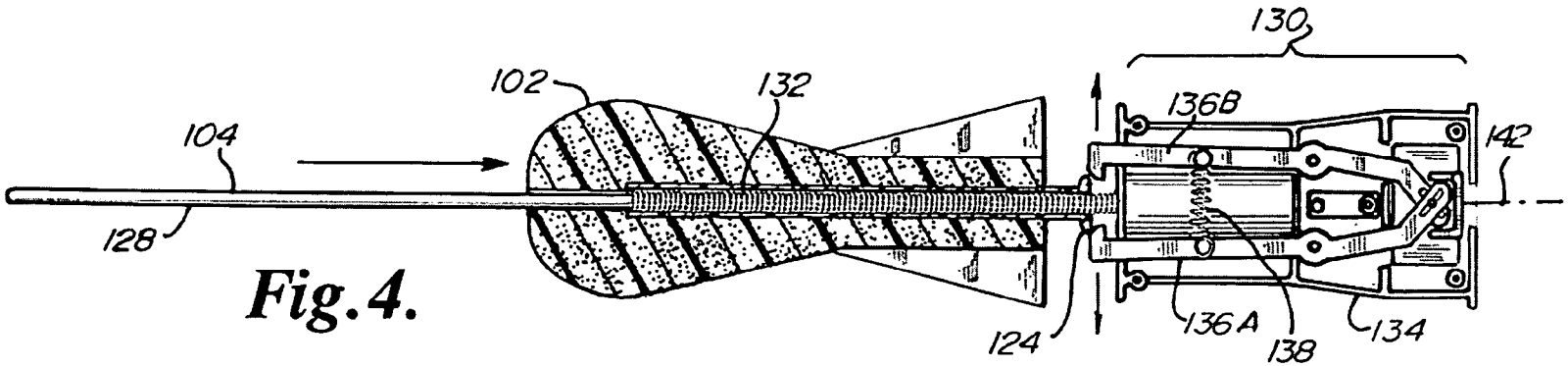
FIG. 4 is a full cross sectional view of the mortar and launching pole of the toy of FIG. 1 showing the loading of the mortar onto the launching pole.
Figure 5:
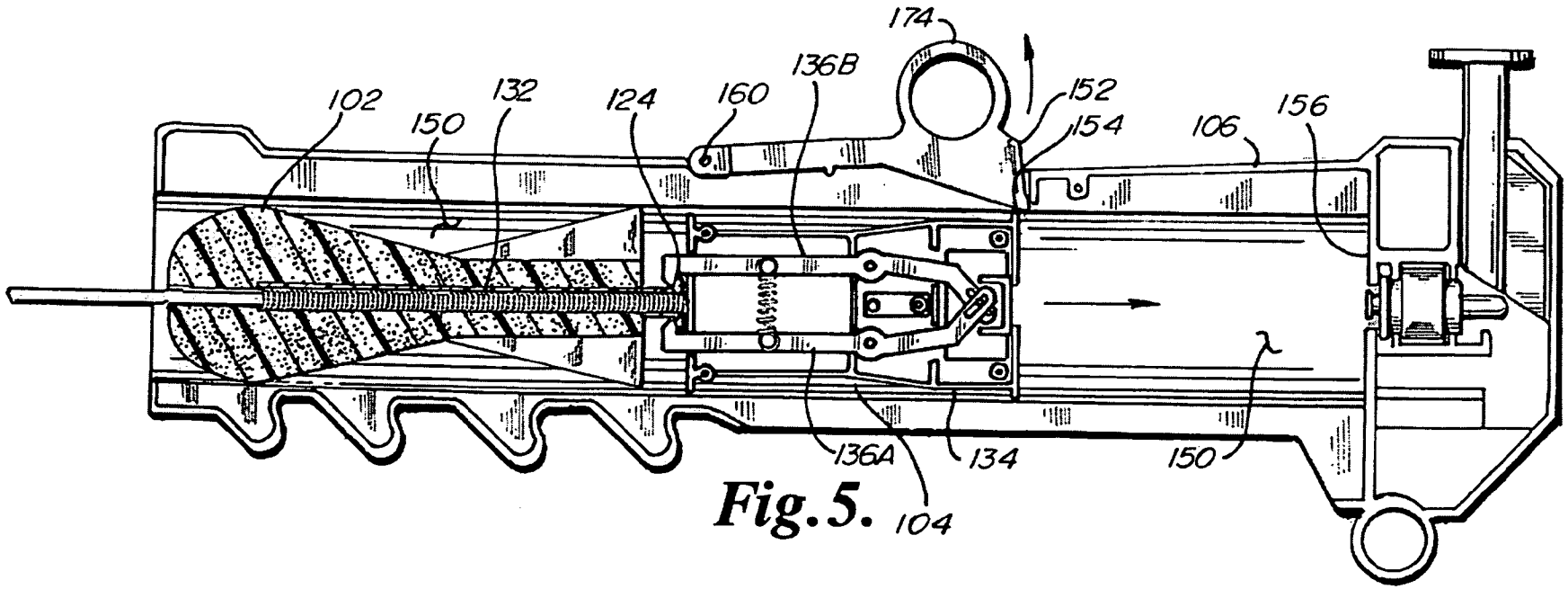
FIG. 5 is a cross sectional view of the loaded mortar/pole subassembly of FIG. 4 and the barrel of FIG. 3, showing the loading of the subassembly into the barrel.

To load the mortar 102 into the barrel 106, and prepare for launching, the mortar is first loaded onto the launching pole 104 as shown in FIG. 4, then the mortar/pole subassembly is loaded into the barrel as shown in FIGS. 5 and 6.

The rod 128 of the launching pole is passed through the hollow tube 118 of the mortar and the mortar is pushed towards the release housing 134 against the force of the longitudinal extension spring 132 until the mortar is captured by the holding fingers 136A and 136B. During assembly of the mortar to the launching pole, the peripheral flange 124 of the mortar tube forces the holding fingers apart as the flange approaches the release housing, as shown in FIG. 4. As the flange reaches the release housing, the fingers snap back inwardly to capture the flange and retain it against the housing, as shown in FIG. 5. The extension spring 132 is fully compressed and exerts its full force between the release housing 134 and the mortar 102.

Figure 3:
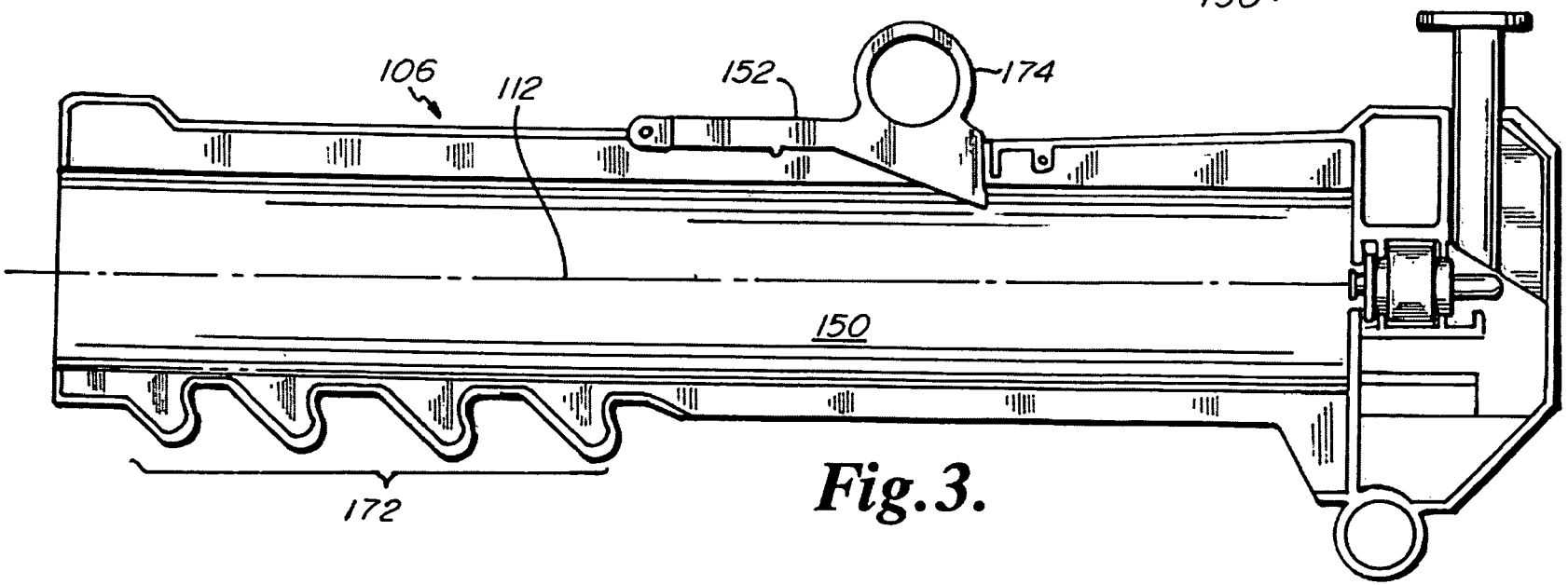
FIG. 3 is a full cross sectional view of the barrel of the toy of FIG. 1.

Now referring to FIGS. 3 and 5, the mortar/pole subassembly is next loaded into the barrel. The barrel includes a simple gravity activated lock 152 for holding the mortar/pole subassembly in the barrel. As the mortar/pole subassembly is being slid down into the hollow interior chamber 150 of the barrel, and the cylindrical release 134 housing first engages the gravity lock 152, the lock is forced upwardly and away from the barrel's longitudinal axis 112 by the lower edge 154 of the release housing, pivoting about its pivot 160. As the release housing passes completely by the lock and the housing and the lower edge of the housing reaches the bottom 156 of the barrel's chamber, the upper edge 158 of the release housing passes and clears lock 152 and the lock pivots by gravity back down towards the barrel's longitudinal axis, thereby locking the subassembly in the barrel. Alternatively, the gravity lock may be biased towards longitudinal centerline by a spring, such as a torsion spring acting at lock pivot 160.

When assembled into the barrel 106, the rod 128 of the launching pole 104 and the mortar 102 are disposed coaxially with the barrel's longitudinal axis 112, and the mortar's body 116, including the widest portion of its finned tail end, are clearingly fitted within the barrel's hollow interior chamber 150.

The barrel further includes a trigger mechanism 162 which cooperates with the holding fingers of the release mechanism to force fingers 136A and 136B from their normal closed position to their open position. The trigger mechanism includes a trigger button 164 that is accessible to the user and a firing pin assembly 166 with which the trigger button cooperates.

The firing pin assembly is biased by an internal firing spring to a non-firing position in which its firing pin 168 is disposed towards the rear end of the gun and away form the release mechanism. An exertion of longitudinal force (perpendicular to the barrel's longitudinal axis) against the trigger button results in the slanted inner end 170 of the button forcing the firing pin from its non-firing position to its firing position against the bias of the firing spring. During this event, the gravity lock 152 holds the release housing 134 in place against the forward force of the firing pin so that all of the firing pin's force acts only on the holding fingers.

The movement of the firing pin 168 towards its firing position causes contact with the tail ends of holding fingers 136A and 136B and forces them to open symmetrically towards their open position against the bias of their holding spring 138. The movement of the fingers towards their release position causes release of the mortar flange 124 from the holding fingers. The release of the mortar flange allows the force of the compressed longitudinal spring 132 of the launching pole to rapidly and forcefully eject the mortar 102 along the guiding rod and from the barrel, as shown in FIG. 7. The close fitting of the outer diameter of the mortar 102 with barrel chamber 150, together with the guidance of the mortar by the guiding rod 128 of the launching pole, cause the mortar to maintain a straight and accurately directed trajectory.

Side-to-side aiming to the mortar are controlled by simply repositioning the entire toy side-to-side. Vertical aiming and distance are controlled by the relationship between barrel 106, stand base 108, and stand supports 110R and 110L. The base is hingedly attached to the rear end of the barrel, and the bottoms of the supports are hingedly attached to the forward end of the base.

The barrel includes a plurality of slots 172 for receiving the top ends of the supports to alter the angular disposition of the barrel from the supporting floor, and to thereby alter trajectory and distance of the mortar's flight. The firing range is found to be over 50 feet when the barrel of the exemplary embodiment is disposed at an angle of approximately forty-five degrees from horizontal. Different angular dispositions of the barrel provide varying trajectories.

After firing, the launching pole 104 is removed from the barrel 106 for reloading by reaching into the barrel to grasp the forward tip of the guiding rod 128 and pulling the pole from the barrel while pulling upwardly on the loop handle 174 of the gravity lock 152.

In a second mode of operation, the user may hold down the trigger button 164 with a first hand, and slide the mortar/pole subassembly down rapidly into the barrel 106 with a second hand. As soon as the release housing reaches the bottom of the chamber, the forwardly protruding firing pin 168 engages the holding fingers 136A and 136B to force them into their releasing position, and the mortar 102 is immediately released, firing instantly from the barrel.

An alternative and less expensive embodiment is anticipated for only the second mode of operation in which the toy excludes the trigger button and the firing spring, and the firing mechanism includes only a firing pin fixed in its firing position . . . thereby causing the same firing pin position as caused by the first hand.

In another anticipated embodiment, the trigger button is aligned with the barrel's longitudinal axis and at the rear end of the barrel so that a user must position himself aside the barrel to hold the trigger button in its firing position with the first hand while sliding the mortar/pole subassembly into the chamber with the second hand. This forces the user to move his body away from the line of fire.

Besides increasing flight accuracy through its symmetry, the dual holding finger design of the release mechanism provides additional safety over a single finger design. The ability of a user to tamper with the loaded mortar/pole subassembly and cause false release is minimized. The holding fingers must be activated by a force coaxial with the release housing's longitudinal axis to cause release of the mortar. A force even slightly non-coaxial is unlikely to cause release, so even the most careful attempt to improperly release the mortar by a mischievous child is unsuccessful.

In summary, the present invention may reside in a combination of a projectile and a launching toy therefore. The launching toy may include a hollow tubular barrel having a release actuator, an adjustable stand for variably fixing the position of the barrel, and a load and release mechanism fixable into and removable from the barrel.

The load and release mechanism may include a longitudinal guiding rod, a longitudinally-acting extension spring surrounding the guiding rod, and a plurality of holding and releasing fingers symmetrically surrounding the guiding rod and cooperating with the release actuator when the load and release mechanism is fixed into the barrel to cause the holding and releasing fingers to move symmetrically about the guiding rod from a holding position to a releasing position.

The load and release mechanism may receive the projectile while the release mechanism is removed from the barrel to become a loaded subassembly, during which the extension spring may be compressed to retain stored energy and the releasing fingers may capture the projectile to the mechanism in the holding position against the stored energy.

This loaded subassembly may be inserted into the barrel to become a readied assembly, and the release actuator of this readied assembly may be selectively actuated to cause the holding and releasing fingers to move from the holding position to the releasing position, thereby releasing the projectile from the load and release mechanism, wherein the stored energy may cause the projectile to be launched from the toy.

The barrel may include a latch having a retaining position for retaining the load and release mechanism in the barrel prior to launching, and a removing position for allowing removal of the load and release mechanism from the barrel after launching.

The retaining position may be one-directional, allowing receipt of the load and release mechanism into the barrel, but denying removal of the load and release mechanism from the barrel. The latch may be biased towards the retaining position.

The plurality of holding and releasing fingers may be symmetrically biased inwardly towards the guiding rod, and each of the holding and releasing fingers may include a retaining latch portion and a pivot portion, the retaining portion of each finger engaging the projectile, and each finger pivoting at the pivot portion during the movement from the holding position to the releasing position to cause the retaining portion to release the projectile.

The projectile may include a soft forward portion and a firm tailward engagement portion, the engagement portion being captured by the releasing fingers in the holding position. And the projectile may be shaped to cause the soft forward portion to remain forward during flight after launching.

The invention may further reside in a method of operating such a launching toy and projectile, including the steps of; receiving the projectile onto the load and release mechanism while the release mechanism is removed from the barrel to become a loaded subassembly, during which the extension spring is compressed to retain stored energy and the releasing fingers capture the projectile to the mechanism in the holding position against the stored energy; inserting the loaded subassembly into the barrel to become a readied assembly; and selectively actuating the release actuator of the readied assembly to cause the holding and releasing fingers to move from the holding position to the releasing position, thereby releasing the projectile from the load and release mechanism, wherein the stored energy causes the projectile to be launched from the toy.

This method may further include the step of retrieving the launched projectile, removing the load and release mechanism from the barrel after launching, and repeating the steps of receiving, inserting, and selectively actuating.

While the invention has been shown and described with reference to a specific exemplary embodiment, it should be understood by those skilled in the art that various changes in form and detail may be made without departing from the spirit and scope of the invention, and that the invention should therefore only be limited according to the following claims, including all equivalent interpretation to which they are entitled.

I claim:

1. In combination, a projectile and a launching toy therefore, said launching toy comprising:

a hollow tubular barrel having a release actuator; and a load and release mechanism fixable into and removable from said barrel and comprising:

a longitudinal guiding rod;

a longitudinally-acting extension spring surrounding said guiding rod; and a plurality of holding and releasing fingers symmetrically surrounding said guiding rod and cooperating with said release actuator when said load and release mechanism is fixed into said barrel to cause said holding and releasing fingers to move symmetrically about said guiding rod from a holding position to a releasing position; and wherein said load and release mechanism receives said projectile while said load and release mechanism is removed from said barrel to become a loaded subassembly, during which said extension spring is compressed to retain stored energy and said releasing fingers capture said projectile to said mechanism in said holding position against said stored energy;

said loaded subassembly is inserted into said barrel to become a readied assembly; and said release actuator of said readied assembly is selectively actuated to cause said holding and releasing fingers to move from said holding position to said releasing position, thereby releasing said projectile from said load and release mechanism, wherein said stored energy causes said projectile to be launched from said toy.

2. The combination of claim 1 wherein said barrel comprises a latch having;

a retaining position for retaining said load and release mechanism in said barrel prior to launching; and a removing position for allowing removal of said load and release mechanism from said barrel after launching.

3. The combination of claim 2 wherein said retaining position is one-directional, allowing receipt of said load and release mechanism into said barrel, but denying removal of said load and release mechanism from said barrel.

4. The combination of claim 3 wherein said latch is biased towards said retaining position.

5. The combination of claim 4 wherein said plurality of holding and releasing fingers are symmetrically biased inwardly towards said guiding rod.

6. The combination of claim 5 wherein each of said holding and releasing fingers comprises a retaining latch portion and a pivot portion, said retaining portion of said each finger engaging said projectile, and said each finger pivoting at said pivot portion during said movement from said holding position to said releasing position to cause said retaining portion to release said projectile.

7. The combination of claim 1 wherein said plurality of holding and releasing fingers are symmetrically biased inwardly towards said guiding rod.

8. The combination of claim 7 wherein each of said holding and releasing fingers comprises a retaining latch portion and a pivot portion, said retaining portion of said each finger engaging said projectile, and said each finger pivoting at said pivot portion during said movement from said holding position to said releasing position to cause said retaining portion to release said projectile.

9. The combination of claim 1 wherein said projectile comprises a soft forward portion and a firm tailward engagement portion, said engagement portion being captured by said releasing fingers in said holding position, and wherein said projectile is shaped to cause said soft forward portion to remain forward during flight after launching.

10. A method of operating a launching toy and a projectile, said launching toy comprising:

a hollow tubular barrel having a release actuator; and a load and release mechanism fixable into and removable from said barrel and comprising:

a longitudinal guiding rod;

a longitudinally-acting extension spring surrounding said guiding rod; and a plurality of holding and releasing fingers symmetrically surrounding said guiding rod and cooperating with said release actuator when said load and release mechanism is fixed into said barrel to cause said holding and releasing fingers to move symmetrically about said guiding rod from a holding position to a releasing position;

wherein said method comprises the steps of:

receiving said projectile onto said load and release mechanism while said load and release mechanism is removed from said barrel to become a loaded subassembly, during which said extension spring is compressed to retain stored energy and said releasing fingers capture said projectile to said mechanism in said holding position against said stored energy;

inserting said loaded subassembly into said barrel to become a readied assembly; and selectively actuating said release actuator of said readied assembly to cause said holding and releasing fingers to move from said holding position to said releasing position, thereby releasing said projectile from said load and release mechanism, wherein said stored energy causes said projectile to be launched from said toy.

11. The method of claim 10 further comprising the step of retrieving said launched projectile, removing said load and release mechanism from said barrel after launching, and repeating said steps of receiving, inserting, and selectively actuating.

12. The method of claim 11 wherein said barrel comprises a latch having;

a retaining position for retaining said load and release mechanism in said barrel prior to launching; and a removing position for allowing removal of said load and release mechanism from said barrel after launching.

13. The method of claim 12 wherein said retaining position is one-directional, allowing receipt of said load and release mechanism into said barrel, but denying removal of said load and release mechanism from said barrel.

14. The method of claim 13 wherein said latch is biased towards said retaining position.

15. The method of claim 14 wherein said plurality of holding and releasing fingers are symmetrically biased inwardly towards said guiding rod.

16. The method of claim 15 wherein each of said holding and releasing fingers comprises a retaining latch portion and a pivot portion, said retaining portion of said each finger engaging said projectile, and said each finger pivoting at said pivot portion during said movement from said holding position to said releasing position to cause said retaining portion to release said projectile.

17. The method of claim 11 wherein said plurality of holding and releasing fingers are symmetrically biased inwardly towards said guiding rod.

18. The method of claim 17 wherein each of said holding and releasing fingers comprises a retaining latch portion and a pivot portion, said retaining portion of said each finger engaging said projectile, and said each finger pivoting at said pivot portion during said movement from said holding position to said releasing position to cause said retaining portion to release said projectile.

19. The method of claim 11 wherein said projectile comprises a soft forward portion and a firm tailward engagement portion, said engagement portion being captured by said releasing fingers in said holding position, and wherein said projectile is shaped to cause said soft forward portion to remain forward during flight after launching.

20. In combination, a projectile and a launching toy therefore, said launching toy comprising:

a hollow tubular barrel having a release actuator;

an adjustable stand for variably fixing the position of said barrel; and a load and release mechanism fixable into and removable from said barrel and comprising:

a longitudinal guiding rod;

a longitudinally-acting extension spring surrounding said guiding rod; and a plurality of holding and releasing fingers symmetrically surrounding said guiding rod and cooperating with said release actuator when said load and release mechanism is fixed into said barrel to cause said holding and releasing fingers to move symmetrically about said guiding rod from a holding position to a releasing position; and wherein said load and release mechanism receives said projectile while said load and release mechanism is removed from said barrel to become a loaded subassembly, during which said extension spring is compressed to retain stored energy and said releasing fingers capture said projectile to said mechanism in said holding position against said stored energy;

said loaded subassembly is inserted into said barrel to become a readied assembly; and said release actuator of said readied assembly is selectively actuated to cause said holding and releasing fingers to move from said holding position to said releasing position, thereby releasing said projectile from said load and release mechanism, wherein said stored energy causes said projectile to be launched from said toy.

* * * * *